US006433683B1

(12) United States Patent
Robinson

(10) Patent No.: US 6,433,683 B1
(45) Date of Patent: Aug. 13, 2002

(54) MULTIPURPOSE WIRELESS VIDEO ALARM DEVICE AND SYSTEM

(75) Inventor: Carl Robinson, 20207 Robinwood Ct., Hagerstown, MD (US) 21742

(73) Assignee: Carl Robinson, Hagerstown, MD (US)

( * ) Notice: Subject to any disclaimer, the term of this patent is extended or adjusted under 35 U.S.C. 154(b) by 0 days.

(21) Appl. No.: 09/514,542

(22) Filed: Feb. 28, 2000

(51) Int. Cl.[7] ..... G08B 21/00

(52) U.S. Cl. ..... 340/540; 340/541; 340/426; 340/429; 340/937; 340/539; 340/574; 348/143; 348/152; 348/153; 348/154; 348/155

(58) Field of Search ..... 340/540, 541, 340/426, 429, 937, 539, 574; 348/143, 152, 153, 154, 155

(56) References Cited

U.S. PATENT DOCUMENTS 4,262,283 A 4/1981 Chamberlain et al. ..... 340/533
4,943,799 A 7/1990 Papineau ..... 340/521
5,045,839 A * 9/1991 Ellis et al. ..... 340/539
5,235,320 A * 8/1993 Romano ..... 340/539
5,319,698 A 6/1994 Glidewell et al. ..... 379/39
5,448,320 A 9/1995 Sakai et al. ..... 379/39
5,463,595 A 10/1995 Rodhall et al. ..... 367/93
5,479,148 A * 12/1995 Umemoto ..... 340/539
5,546,072 A * 8/1996 Creuseremee et al. ..... 340/574
5,625,338 A * 4/1997 Pildner et al. ..... 340/539
5,878,283 A * 3/1999 House et al. ..... 396/6
5,926,209 A * 7/1999 Glatt ..... 348/143
5,963,131 A * 10/1999 D'Angelo et al. ..... 340/568.1
6,049,273 A * 8/2000 Hess ..... 340/539

* cited by examiner

*Primary Examiner*—Daniel J. Wu
*Assistant Examiner*—Tai T. Nguyen

(57) ABSTRACT

The invention is an alarm system which transmits audio and video signals using radio frequency of a monitored enclosure to a remote location by means of wireless technology when said alarm system is triggered by an alarm sensor. The RF transmission of the audio visual signal will continue until the condition which triggered the alarm sensor ceases or until the alarm system is reset either using the system alphanumeric keypad or by the remote location using a keypad of a telecommunications device.

1 Claim, 4 Drawing Sheets

MULTIPURPOSE WIRELESS VIDEO ALARM DEVICE AND SYSTEM

BACKGROUND OF THE INVENTION

1. Field of the Invention

The present invention relates generally to alarm systems and, more specifically, to an alarm system which transmits audio and video signals of the enclosure to a remote location by means of wireless technology when said alarm system is triggered by an alarm sensor. The transmission of the audio visual signal will continue until the condition which triggered the alarm sensor ceases or until the alarm system is reset by the remote location.

2. Description of the Prior Art

There are other alarm system devices designed for transmitting signals to remote sites about predefined alarm conditions. Typical of these is U.S. Pat. No. 4,262,283 issued to Chamberlain et al. on Apr. 14, 1981.

Another patent was issued to Papain on Jul. 24, 1990 as U.S. Pat. No. 4,943,799. Yet another U.S. Pat. No. 5,319,698 was issued to Glidewell et al. on Jun. 7, 1994 and still yet another was issued on Sep. 5, 1995 to Sakai et al. as U.S. Pat. No. 5,448,320.

Another patent was issued to Rodhall et al. on Oct. 31, 1995 as U.S. Pat. No. 5,463,595.

U.S. Pat. No. 4,262,283

Inventor: Ian C. Chamberlain et al.

Issued: Apr. 14, 1981

An alarm system for transmitting alarm information via telephone lines has a plurality of alarm transmitters which are located at subscribers' premises and are adapted to transmit signals indicative of the state of alarms associated with the transmitters along telephone lines to associated receivers. The receivers are located at one or more local exchanges and the receivers at a local exchange are all connected to a local processor. The or each local processor is connected to a central processor which can direct alarm information to one of a number of terminal stations. The local processors continuously scan the outputs of the receivers. When a local processor detects a signal indicative of an alarm condition it transmits a signal coded with the subscriber identity and destination for the alarm information to the central processor which routes the alarm message to the appropriate terminal station. Each transmitter produces a carrier wave which is modulated with one or more other frequencies according to the state of the alarm being monitored.

U.S. Pat. No. 4,943,799

Inventor: Papain

Issued: Jul. 24, 1990

A portable alarm system includes a compact portable sealed housing having an electronic alarm control circuit therein. An electrical a.c. cord supplies power to the control circuit and plugs into the housing. A telephone jack connects a telephone circuit to a dialer circuit within the control circuit. A digital key pad is secured to the housing and has a plurality of switches actuable exteriorly of the housing whereby to program the control circuit by a lessor person and for actuating or deactuating the control circuit by a lessee user person. A receiver circuit is also provided in the housing and is connected to the control circuit. One or more wireless infrared detectors are detachably secured to the housing and positioned to detect moving objects within an environment to be protected. The detectors have infrared transmitters, of different frequencies, and transmit alarm signals to the receiver. The receiver has a first channel which is responsive to a first detector and is connected to the control circuit through a delay circuit so that the control circuit only switches to an alarm state to generate an alarm code on the telephone line after a predetermined time delay. The second channel of the receiver has no delay circuit. A siren is connected to the control circuit and secured to the housing to generate an audible local alarm upon activation of the control circuit to the alarm state.

U.S. Pat. No. 5,319,698

Inventor: Glidewell et al.

Issued: Jun. 7, 1994

A security system for detecting and signalling the presence of abnormal security or hazardous conditions, such as unauthorized entry, glass breakage, fire, smoke, high water level, in individual units, such as a boat, a recreational vehicle, an automobile, which are located or stored in a given security area. The security system comprises sensor units which, when actuated, transmit coded signals through the atmosphere which identifies each sensor unit and the individual unit on which it is located. A receiver on the individual unit recognizes only the coded signals from sensor units which are on the same individual unit as the receiver. A coded output signal is provided to a slave transmitter on the individual unit which identifies the particular sensor unit which was actuated. The slave transmitter provides a coded transmission signal to a local security station which identifies the particular sensor unit which was actuated and the individual unit where the actuated sensor unit resides. The local security station activates an alarm and dials a sequence of telephone numbers to provide a verbal alarm.

U.S. Pat. No. 5,448,320

Inventor: Sakai et al.

Issued: Sep. 5, 1995

A automatic surveillance camera equipment contains an infrared ray detecting sensor having a plurality of sensing zones and for detecting an intruder within a watching area and transmitting its signal to a control device, a control device for sending a command signal to a camera unit in response to the signal from the infrared ray detecting sensor, a camera unit for supplying a response signal to a camera in response to the command signal from the control device, a camera for synchronizing a strobe and a camera shutter each other by the response signal from the camera unit, automatically shooting, and automatically rewinding a film simultaneously together in a protective case, and is intended to perform photography of an intruder on each of the sensing zones of the infrared sensor when the intruder enters the watching area. An alarm system is directly communicated to the outside through a telephone line to transmit a signal.

U.S. Pat. No. 5,463,595

Inventor: Rodhall et al.

Issued: Oct. 31, 1995

A security system (10) suitable for use in monitoring property at an outdoor site that includes a portable housing

(12) that supports a motion detector (14) for sensing motion within a detection zone. The security system further includes an ultrasonic transducer (74) and several alarm generators capable of repelling a human intruder, including a high intensity illumination source (18), high decibel siren (82), strobe light (19), and a speaker (78) for transmitting a prerecorded message. When an intrusion is initially detected by the motion detector, the ultrasonic transducer is activated to emit an ultrasonic signal that is irritating to nonhuman animals, thus clearing the detection zone of nonhuman intruders. If after sounding of the ultrasonic transducer motion is still detected, one or more of the alarms is activated. Additionally, an automatic telephone dialer (86) may be included in the system and activated by the system as another type of alarm, in response to detected intrusion. The system is integrated within the portable housing and is resistant to false alarms, making it suitable for use in monitoring property stored at an outside site. A method for utilizing the security system to protect property is also disclosed.

While these alarm systems may be suitable for the purposes for which they were designed, they would not be as suitable for the purposes of the present invention, as hereinafter described.

SUMMARY OF THE PRESENT INVENTION

While there are numerous alarm system in existence which use telephone lines as a means for alerting a remote monitoring location of an alarm condition, it is well known that experienced burglars will cut or impede transmission lines before breaking in. Also, there are transmission line problems which increase due to the aging of the twisted wire pair system. Even with the advent of fiber optic cables the problem still exists that any hardwired system can be impeded from generating alarm signal by cutting the transmission lines.

With this in mind, it has become evident that the only secure alarm system is one which creates a security zone around the alarm transmission device. One must pass through the sensors to disable the system.

Therefore, the use of radio frequency as a carrier for an alarm condition has an unequaled advantage over transmission line systems. Even power failures are no longer a problem, as most high end systems incorporate some type of battery backup.

The mobile telephone system solved many of the aforementioned problems but carries it own serious problem in that there are a limited number of radio frequency channels which seriously limits its use.

The final clear advantage belongs with cellular phone technology which thrives under crowded city conditions as well as suburbia and is currently limited only by how fast new telephone exchanges can be assigned and cell towers constructed.

There are a number of alarm systems which use cellphone technology to report alarm conditions to remote monitoring sites. These alarm conditions are limited only by the myriad number of sensors which have been developed, such as, perimeter sensors, fire sensors, motion detectors, medical emergency, etc,.

Cellular phone technology does overcome all of the aforementioned shortcomings but also creates some new ones. With millions of these systems online and reporting to monitoring station the response system will quickly become overburdened.

Therefore it is felt that a need exists and it is a primary object of the present invention to overcome all of the shortcomings of the aforementioned systems by wireless transmission of real time video and audio signals from the enclosure being monitored whether it be an automobile, office or home. Thereby, the remote location can ascertain false alarms, breaking glass from the neighborhood baseball game, a life threatening situation such as fire or medical emergency or a burglary in progress and respond accordingly.

A primary object of the present invention is to provide a multipurpose wireless video alarm device and system.

Another object of the present invention is to provide a multipurpose wireless video alarm device having a microprocessor, transmitter, receiver, keypad, microphone and input means for connecting one or more sensors.

Yet another object of the present invention is to provide a multipurpose wireless video alarm device having a ccd camera electrically connected thereto.

Still yet another object of the present invention is to provide a multipurpose wireless video alarm device having one or more alarm sensors electrically connected thereto.

Another object of the present invention is to provide a multipurpose wireless video alarm device having control means responding to an alarm sensor and establishing a wireless transmission to a predetermined remote site.

Yet another object of the present invention is to provide a multipurpose wireless video alarm device having control means responding to an alarm sensor and establishing a wireless transmission to a predetermined remote site for the transmission of video signals from the ccd module.

Still yet another object of the present invention is to provide a multipurpose wireless video alarm device having control means responding to an alarm sensor and establishing a wireless transmission to a predetermined remote site for the transmission of audio signals from the microphone module.

Another object of the present invention is to provide a multipurpose wireless video alarm device having receiving means whereby incoming transmissions have access to control means for resetting said device and program control means using a remote telephone keypad.

Yet another object of the present invention is to provide a multipurpose wireless video alarm device having a microprocessor having a program instruction set.

Still yet another object of the present invention is to provide a multipurpose wireless video alarm system having a multipurpose video alarm device and a remote monitor for receiving and playing said audio/visual signals.

Additional objects of the present invention will appear as the description proceeds.

The present invention overcomes the shortcomings of the prior art by providing an alarm system incorporating wireless transmission technology for an alarm sensor which transmits to a user designated location real time audio and video signals of the monitored enclosure.

Further, the alarm system can be remotely programmed using a remote telephone keypad.

In addition the present invention provides an additional element in the form of a remote location monitor whereby the transmitted audio/video signals can be played.

The foregoing and other objects and advantages will appear from the description to follow. In the description reference is made to the accompanying drawing, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawing, like reference characters designate the same or similar parts throughout the several views.

The following detailed description is, therefore, not to be taken in a limiting sense, and the scope of the present invention is best defined by the appended claims.

LIST OF REFERENCE NUMERALS UTILIZED IN THE DRAWINGS

10 multipurpose wireless video alarm system
12 multipurpose wireless video alarm device
14 microprocessor
16 alarm detector
18 microphone
20 ccd camera
22 alphanumeric keypad
24 antenna
26 ac power
28 cellular transceiver
30 transmission module
32 receiver module
36 battery
38 ac/dc converter
40 relay
42 remote transceiver
44 transceiver keypad
46 transceiver monitor
50 alarm engaged
52 alarm code generated
54 camera engaged
56 microphone engaged
58 call to pre-programmed number
60 a/v signals transmitted
62 control codes transmitted
64 transmission terminated

BRIEF DESCRIPTION OF THE DRAWING FIGURES

In order that the invention may be more fully understood, it will now be described, by way of example, with reference to the accompanying drawing in which.

DETAILED DESCRIPTION OF THE PREFERRED EMBODIMENT

Figure 1:
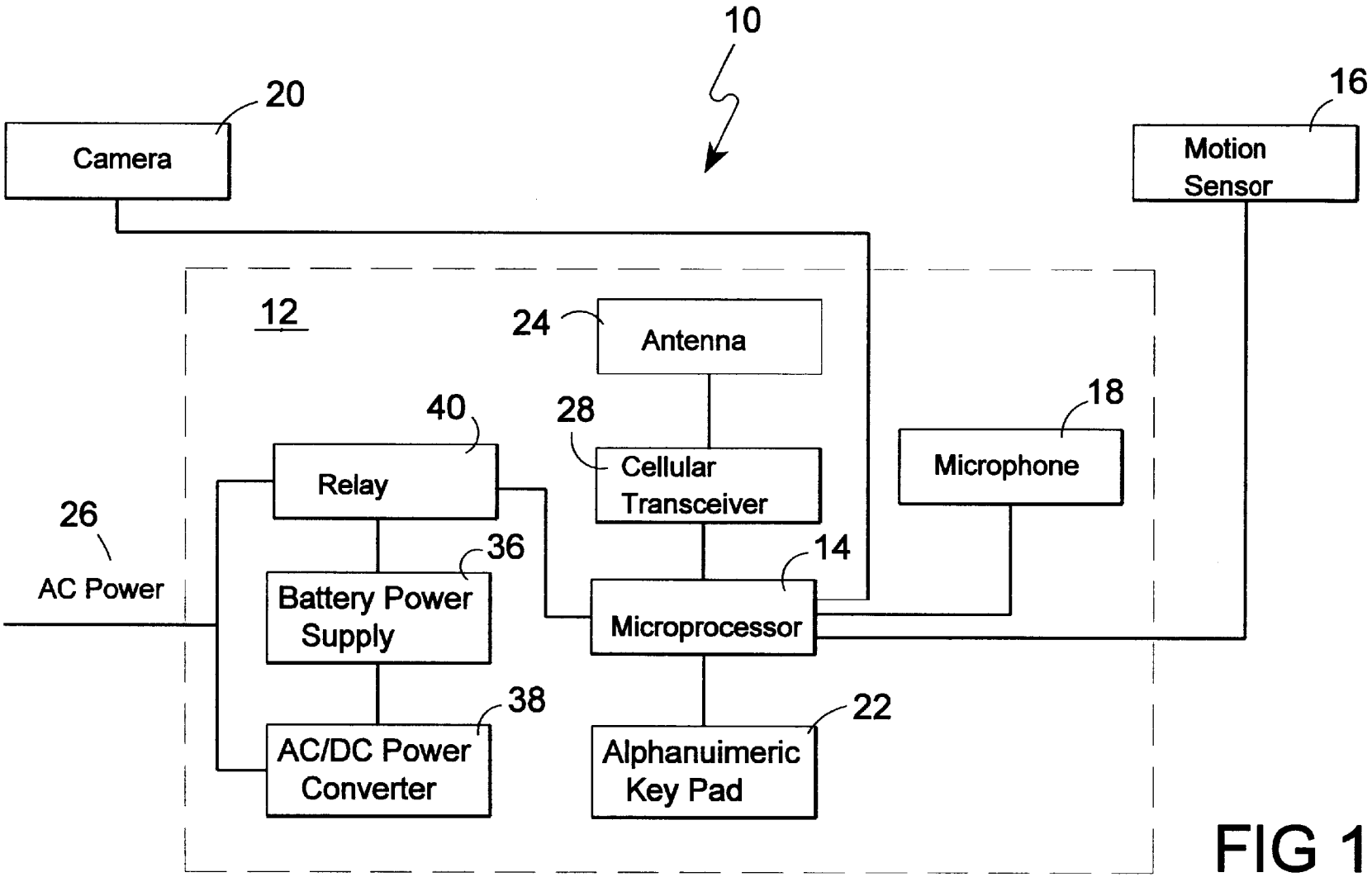
FIG. 1 is a block diagram of the present invention.

Turning now descriptively to the drawings in which similar reference characters denote similar elements throughout the drawing figures. FIG. 1 through FIG. 4 illustrate the multipurpose wireless video alarm system of the present invention indicated generally by the numeral 10.

Referring to FIG. 1 the multipurpose wireless video alarm system (10) is comprised of RF transmission device (12) which uses one or more alarm detection device(s) (16) to engage the recording of video within a monitored enclosure by a ccd camera (20), audio recording by a microphone (18) and the dialing of a pre programmed phone number using RF transmission to link the cellular transceiver (28) with a remote location. Whereby, the recorded real time audio video signals from the monitored enclosure are transmitted by the cellular transceiver (28) to the remote location. The multipurpose wireless video alarm device (12) uses an ac power source (26) which is electrically connected to an ac/dc converter (38) that continuously charges the battery power supply (36) which is engaged by relay (40) in the event of an ac power failure. The multipurpose wireless video alarm device (12) has an alphanumeric keypad (22) that is used to program microprocessor (14) with a variety of user selectable functions, such as, the aforementioned remote transmission telephone number. Also, the system can be preprogrammed with control codes that are used to remotely activate and deactivate the multipurpose wireless video alarm device (12) through the cellular transceiver (28) and antenna (24).

Figure 2:
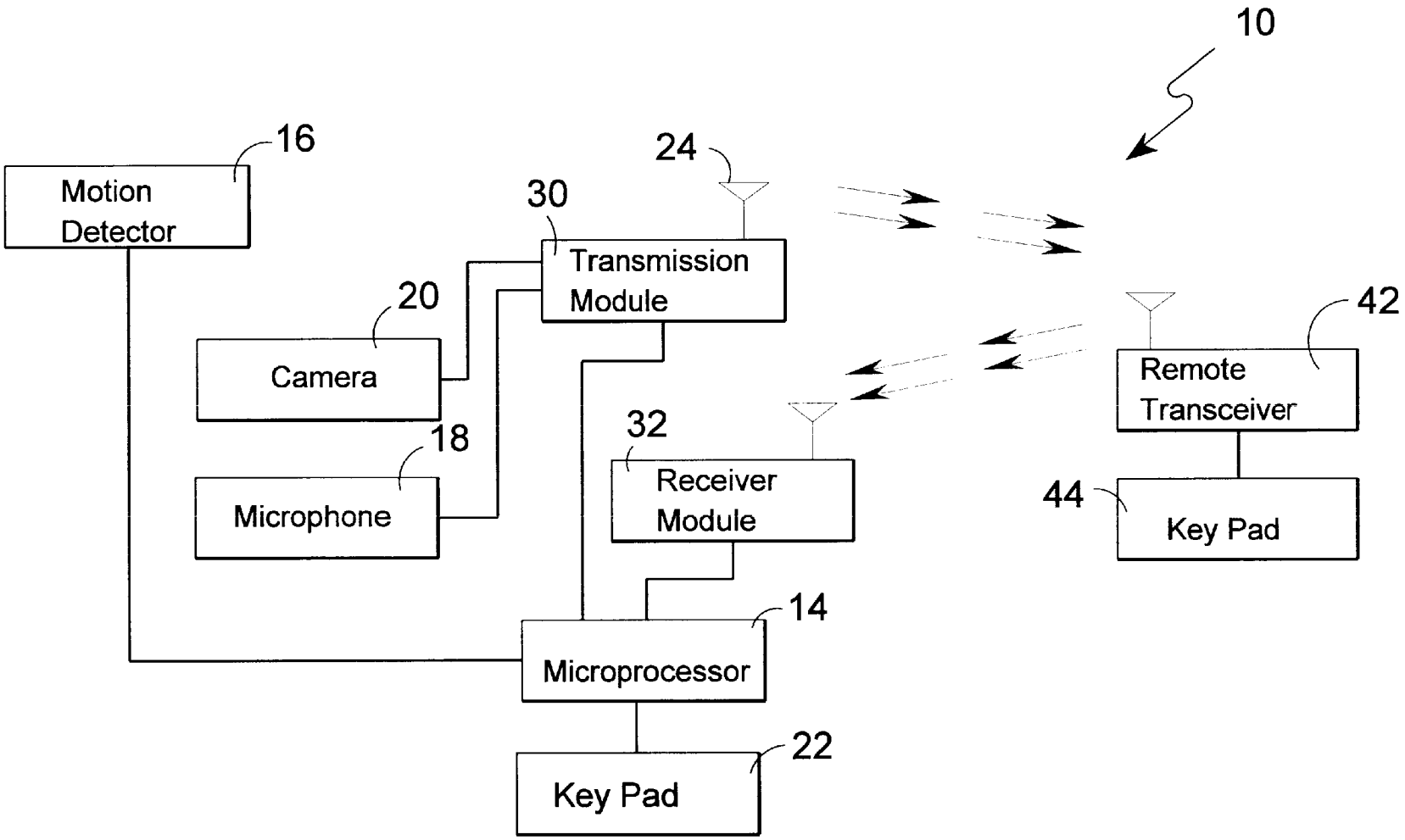
FIG. 2 is block diagram showing the interrelationship of the system components with a remote site.

Referring to FIG. 2, the motion detector (16) initiates an alarm sequence through microprocessor (14) which engages the ccd camera (20) to begin recording and engages the microphone (18). The microprocessor (14) further engages the transmission module (30) of cellular transceiver (28) to initiate a RF transmission using the pre-programmed telephone number. Once a transmission link has been established with the remote transceiver (42), the microprocessor (14) cause the continuous broadcast of the video signal from ccd camera (20) and audio signals from microphone (18) to the remote transceiver (42). The key pad (44) of the remote transceiver (42) can be used to terminate the transmission by transmitting the appropriate codes to the receiver module (32) of cellular transceiver (28) or through the alphanumeric keypad (22) located on the multipurpose wireless video alarm device (12).

Figure 3:
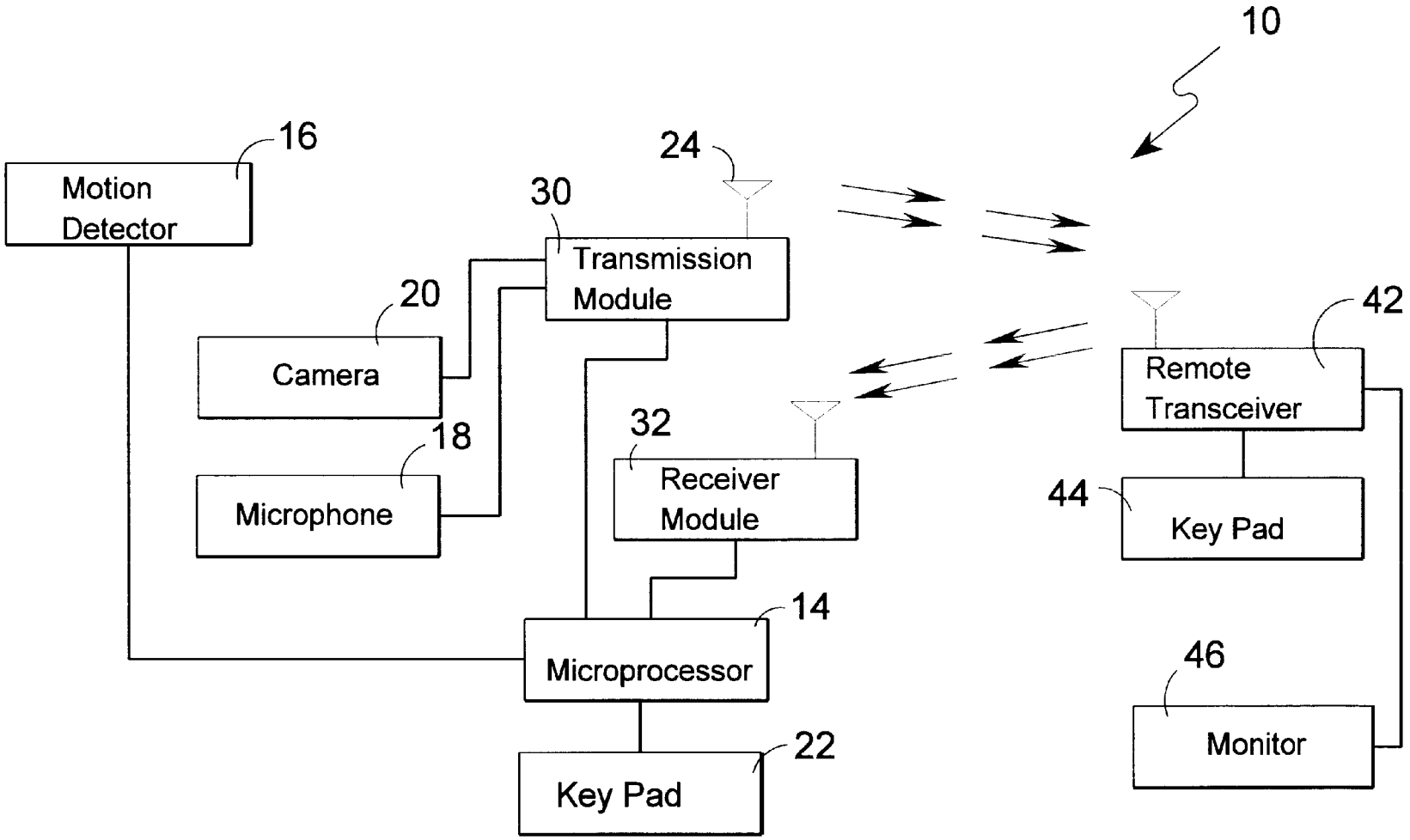
FIG. 3 is block diagram showing the interrelationship of the system components with a remote site having an additional element in the form of a monitor.

Referring to FIG. 3, the multipurpose wireless video alarm device (12) as described in FIG. 2 has an additional element, whereby, the motion detector (16) initiates an alarm sequence through microprocessor (14) which engages the ccd camera (20) to begin recording and engages the microphone (18). The microprocessor (14) further engages the transmission module (30) of cellular transceiver (28) to initiate a RF transmission using the pre-programmed telephone number. Once a transmission link has been established with the remote transceiver (42), the microprocessor (14) cause the continuous broadcast of the video signal from ccd camera (20) and audio signals from microphone (18) to the remote transceiver (42) having monitor (46) for real time viewing of the transmitted audio video signal.

The key pad (44) of the remote transceiver (42) can be used to terminate the transmission by transmitting the appropriate codes to the receiver module (32) of cellular transceiver (28) or through the alphanumeric keypad (22) located on the multipurpose wireless video alarm device (12).

With the inclusion of a GPS module the present invention would not only transmit the real time audio and video signal of the monitored enclosure but would also transmit the current location of the monitored enclosure which would prove invaluable in locating stolen vehicles. Also, the transmission of live audio and video could aid the police in determining whether the perpetrators were career criminals for mischievous kids.

Figure 4:
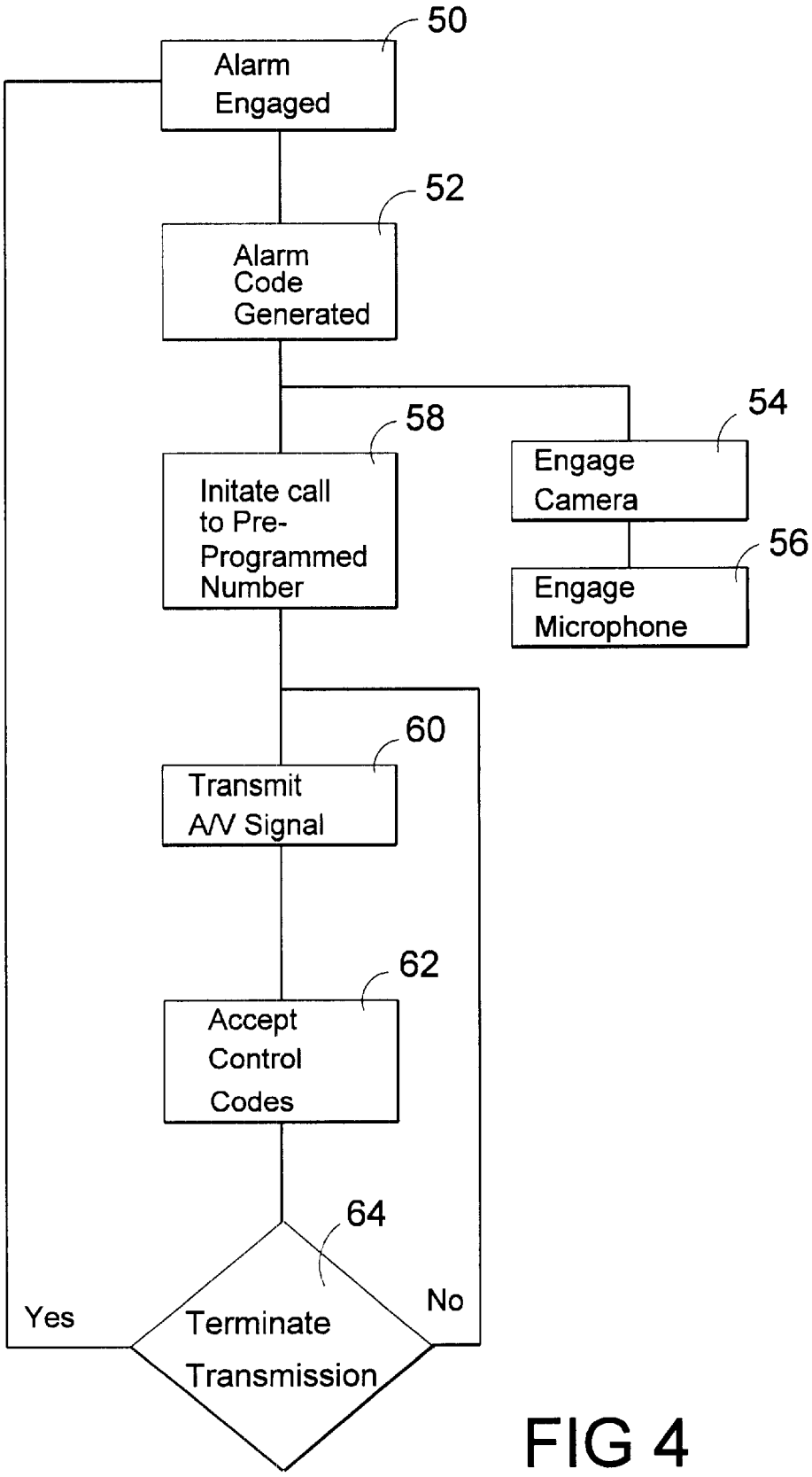
FIG. 4 is a flow diagram of the present invention in an engaged alarm state.

Referring to FIG. 4, when an alarm detector (16) detects an alarm condition (50) an alarm code is generated (52), the ccd camera is engaged (54), the microphone is engaged (56) and a call to the user specified pre-programmed number (58). The multipurpose wireless video alarm device (12) transmits the audio video signal (60) according to pre-programmed preset and is in a condition of two way communication, whereby, the remote RF transceiver can terminate the transmission (64) by generating pre-programmed control codes (62). The user at the remote RF transceiver has the option of deactivating the multipurpose wireless video alarm device (12) or resetting the device.

What is claimed is new and desired to be protected by Letters Patent is set forth in the appended claims:

1. A multipurpose wireless video alarm system for automobiles, trucks, boats, trailers, recreational vehicles, and stationary structures comprising:

a) a wireless alarm device having means including a motion detector for detecting an alarm condition and generating an alarm code and a cellular transceiver capable of RF transmission;

b) means comprising a microprocessor in said device in response to said alarm code for activating a ccd camera and a microphone contained within said device to begin recording and to initiate a RF transmission using a preprogrammed telephone number;

c) said cellular transceiver simultaneously remotely transmitting audio and video signals produced by said camera and microphone using radio frequency once a transmission link has been established with a remote transceiver;

d) said wireless alarm device having a keypad for programming said microprocessor to perform a variety of selectable functions including the selection of a remote transmission telephone number for directing where said audio and video signals are sent;

e) a remote wireless device including said RF transceiver for receiving said audio and video signals;

f) said remote wireless device having a monitor for displaying and broadcasting in real time the signals originated by said camera and microphone; and g) said remote wireless device having a keypad for sending control codes to said wireless alarm device to control the operation of said wireless alarm device including the selective activation or deactivation of said multipurpose wireless video alarm system.

* * * * *